United States Patent [19]

Kern et al.

[11] 4,325,700

[45] Apr. 20, 1982

[54] POSITION-RETENTIVE VALVE SEAT FOR HYDRAULIC CYLINDER

[75] Inventors: Calvin V. Kern, Maumee; Lawrence P. Zepp, Bowling Green, both of Ohio

[73] Assignee: Eltra Corporation, Toledo, Ohio

[21] Appl. No.: 146,891

[22] Filed: May 5, 1980

[51] Int. Cl.[3] ..... B63H 5/12

[52] U.S. Cl. ..... 440/61; 440/56; 440/65; 92/13.1; 91/422

[58] Field of Search ..... 440/56, 61, 65; 248/640; 92/9, 13, 13.1, 26, 75, 13.51, 85 B, 134, 181 R; 91/422

[56] References Cited

U.S. PATENT DOCUMENTS

| | | | |
|---|---|---|---|
| 1,706,812 | 3/1929 | Pfau | 92/9 |
| 2,596,471 | 5/1952 | Densmore et al. | 92/13.1 |
| 2,936,712 | 5/1960 | Gerpen | 92/13 |
| 3,434,449 | 3/1969 | North | 440/56 |
| 4,096,820 | 6/1978 | Hall | 440/61 |
| 4,216,737 | 8/1980 | Niederste-Hollenberg et al. | 440/61 |

*Primary Examiner*—Trygve M. Blix
*Assistant Examiner*—Stephen P. Avila
*Attorney, Agent, or Firm*—James P. DeClercq

[57] ABSTRACT

A hydraulic cylinder having a piston position memory element is disclosed, and is particularly adapted for use with propulsion units for watercraft. A valve seat (76,242) is frictionally retained in a bore of a cylinder (24,200) and cooperates with a valve (72,266) in a piston (70,244) to stop the piston (70,244) in a preset position by blocking the flow of fluid through the valve (72,266).

In a first embodiment, a poppet valve 60 is provided to allow a piston (70) to move to dissipate the energy of a collision of a watercraft propulsion unit with a stationary object, the piston (70) being provided with a valve (72) to allow the piston (70) to return to its original position. The valve seat (76) having remained in its original position and being provided with an unrestricted aperture (78) stops the piston (70) in its original position.

In a second embodiment, a piston (244) includes concentrically mounted valves (260,266), a first valve (260) allowing a drive unit for a watercraft to deflect in response to a collision with a stationary object, and a second valve (266) allowing the drive unit to return to its original position, being stopped in original position by a valve seat (242) which has remained in original position, being provided with unrestricted apertures (254), and stops the flow of fluid through the second valve (266).

A hydraulic system utilizing the first embodiment in a system including a pump assembly (20), a cylinder assembly (24) a base assembly (26) and a pressure amplifier assembly (28) is also disclosed.

24 Claims, 10 Drawing Figures

POSITION-RETENTIVE VALVE SEAT FOR HYDRAULIC CYLINDER

The instant application refers to the general area of hydraulic elements that provide a position memory for a piston in a hydraulic cylinder. In Particular, the application relates to such memory elements used in tiltable outboard motors and stern drive units for small boats.

BACKGROUND OF THE INVENTION

The use of more than one piston in a cylinder, to provide a position memory for a second piston, by using a separate hydraulic circuit, is well known. The memory piston is typically called a "stop piston", which may or may not be permitted to move in the same part of a cylinder bore as the main working piston. Such pistons have been used to give a hydraulic cylinder rod three discrete stop positions, for power shifting of a conventional automotive transmission, and have been used to give read heads in disk-type memory systems for use with digital computers sixteen discrete positions, in response to binary-coded hydraulic inputs. Such structures have also been used in the field of agriculture, to control the lower position of agricultural ground-working tools, when they are returned to lowered positions after having been raised, such as disclosed in U.S. Pat. No. 2,596,471, issued to Densmore et al on May 13, 1952, and for an impact dampening and power lift mechanism for an outboard propulsion mechanism for a small boat, as disclosed in U.S. Pat. No. 3,434,449, issued to North on Mar. 25, 1969.

Such devices share a common deficiency, in that, the stop piston being impervious to the working fluid of a hydraulic cylinder, complicated arrangements are needed to provide working fluid under pressure to both surfaces of a stop piston, as well as to both surfaces of a working piston.

A hydraulic system may be used with a propulsion unit for a small boat to tilt the propeller and its associated driving members, out of the water, for maintenance, or for running the boat onto a shore, without damage to the propulsion unit. Such hydraulic systems also provide for the adjustment of the position of the propeller of the like with respect to the center line of the boat, so that the angle of thrust may be varied for best performance with varying loads, and under varying wave conditions. Such a system must keep the thrust of the propeller from changing the preset trim angle when it is pushing the boat forward in the water, and must also keep the propeller from changing the trim angle and pulling itself out of the water when operating in a reverse direction. This particular function is known as reverse locking. However, such a drive unit must not be held in a position unyeildingly, since it is desirable that the propulsion unit swing upward, and out of the way of submerged obstacles and the like, should a boat run over such an obstacle in operation. After being deflected by such an obstacle, it is desirable that the propulsion unit return to its original position, without further involvement by the operator of the boat. In short, such a system should also provide pressure relief and shock damping functions. These functions have been accomplished in numerous ways. For example, separate cylinders, have been used for trimming and tilting functions. Reverse locking functions have been accomplished by manual valves, pilot-operated valves, valves operated by a gear selector quadrant lever, pressure relief valves, and spring-loaded latches, with either separate small unlatching actuators or increased hydraulic pressure used to break the latches free to intentionally tilt the propulsion unit upward. Pressure relief valves and spring-loaded latches have been used to allow the propulsion unit to swing upward when contacting a submerged obstacle, and thereafter return to a position that was determined by a bolt movable to one of a number of holes, or by the end of an adjustable rod controlled by a wire from the operators' station of the boat, or the separate trim cylinder, or an auxiliary stop piston in a combined trim and tilt cylinder.

The instant invention overcomes numerous disadvantages and deficiencies of such prior structure.

SUMMARY OF THE INVENTION

It is a principle object of the invention to provide a trim and tilt cylinder for use with a propulsion unit for a small boat, combined in a single integral unit with a simple and uncomplicated structure, which will allow the propulsion unit to deflect upon contacting a submerged obstacle, and return to its previous position when clear of the obstacle.

It is a further primary objective of the invention to provide a memory element to establish a trim position to which the propulsion unit can return after deflection in the form of a floating valve seat within the cylinder, cooperating with a valve within a piston, to stop the flow of a fluid through the valve, and thereby stop the piston movement. The valve within the piston serves to limit the rate at which the piston returns toward its original position.

It is a further object of the invention to provide a hydraulic cylinder with a position-retentive valve seat which stops the flow of fluid through a valve in a piston, thereby stopping the piston in a predetermined position, where both valves necessary to allow movement of the piston in opposite directions are concentrically mounted within the piston.

It is a further object of the invention to provide a hydraulic cylinder with a position-retentive element that is not affected by random hydraulic pressure differentials when separate from a piston, but which may be hydraulically repositioned when in contact with the piston.

It is a further object of the invention to provide a hydraulic lifting mechanism for a propulsion unit for a boat, including a position-retentive valve seat in a cylinder, cooperating with a valve in a piston, and including a pump means and a pressure amplifier means for allowing limited movement of the propulsion unit while the propulsion unit is delivering full thrust.

DESCRIPTION OF THE PREFERRED EMBODIMENTS

Figure 1:
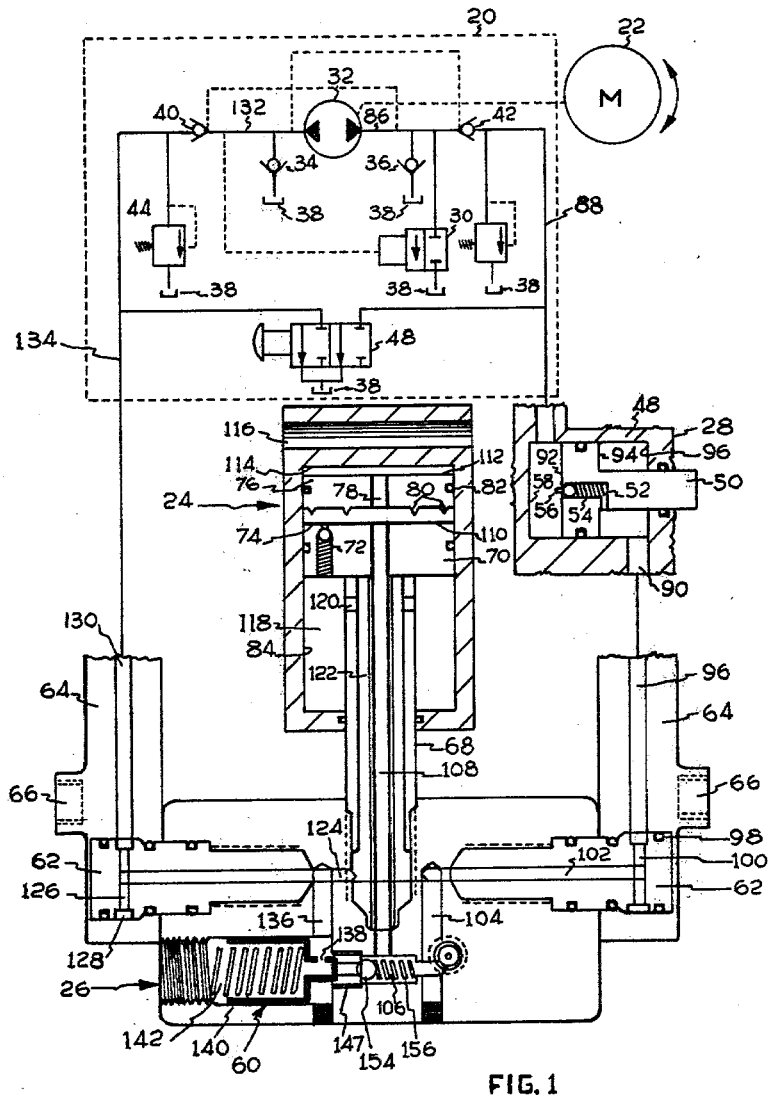
FIG. 1 is a partially-symbolic sectional view of a hydraulic trim and tilt system emboding the invention.

As shown in FIG. 1, a system emboding the invention includes a pump assembly 20, driven by a reversible motor 22, a cylinder assembly 24, a base assembly 26, and a pressure amplifier assembly 28. Pressure amplifier assembly 28 is disclosed in U.S. Pat. application Ser. No. 070,378, filed Aug. 27, 1979, entitled "HYDRAULIC TRIM TILT SYSTEM FOR OUTBOARD PROPULSION UNITS USING A PRESSURE AMPLIFIER". Pump assembly 20 includes a valve 30, which is the subject of U.S. Pat. application Ser. No. 132,555, filed Mar. 21, 1980, entitled "ANTI-SUPERCHARGE VALVE", and is shown schematically here for purposes of illustration.

Pump assembly 20 includes a pump 32, replentisher valves 34 and 36 connected to reservior 38, pilot-operated check valves 40 and 42, pressure relief valves 44 and 46, and a manual release valve 48. Pressure amplifier assembly 28 includes a cylinder body 48, a differential piston 50, having a bypassing switch means here shown as a passage 52 containing a pressure relief valve assembly 54, which may be mechanically opened by contact of plunger 56 with surface 58 of cylinder body 48. Base assembly 26 includes a pilot-operated pressure relief valve assembly 60, which allows a propulsion unit to be deflected upwards due to contact with an obstacle. It should be noted that pressure relief valve 60 need not be mounted as shown for an operative embodiment of the invention. Base assembly 24 also includes pivot means 62 for connecting base assembly 26 to mounting provisions 64. Mounting provisions 64 are provided with threaded apertures 66, intended to be operatively connected to the transom of a water craft.

Figure 1A:
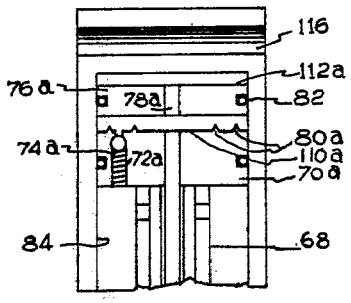
FIG. 1*a* is a fractional view of an alternate embodiment of the piston and valve seat of FIG. 1.

Cylinder assembly 24 includes a rod assembly 68, a piston 70 including at least one pressure relief valve such as valve 72, disposed in an aperture 74 through piston 70. A cylinder assembly 24 according to the invention includes a position-retentive valve seat 76, having an unrestricted aperture 78 therethrough, and may be provided with sealing ridges or the like 80. FIG. 1*a* shows sealing ridges 80*a* positioned on piston 70*a*, valve seat 76*a* being flat, and including unrestricted aperture 78*a*. Sealing ridges 80*a* are preferably two concentric rings, aperture 74*a* with valve 72*a* being located between the two sealing ridges 80*a*. In all other respects, FIG. 1*a* is similar to the relevant portion of FIG. 1, the suffix "a" being used to identify corresponding portions of FIG. 1*a*. Seal means may also be provided on a piston such as piston 70*a*, shown in FIG. 1*a*. Valve seat 76 or 76*a* is frictionally retained, such as by O-ring 82, within bore 84 of cylinder assembly 24. Valve seat 76 or 76*a* may also be close fit within bore 84, or be formed from a resilient material so that O-ring 82 would not be necessary to provide additional friction. As will be explained in greater detail below, when piston 70 or 70*a* and valve seat 76 or 76*a* are adjacent, valve seat or 76 or 76*a* blocks the flow of fluid through aperture 74, thereby preventing piston 70 from moving.

Should it be desired to extend cylinder assembly 24 to raise a propulsion unit provided with a hydraulic system embodying the invention, motor 22 is energized to rotate pump 32 to cause pressurized hydraulic fluid at port 86 of motor 22. Fluid under pressure at port 86 opens pilot operated check valve 40 to provide for return flow, and opens check valve 42, to flow through line 88 to pressure amplifier 48. As illustrated in FIG. 1, differential piston 50 then moves to the right. It should be noted that directions of movement are not related to the use of the invention, there being no inherent limitations on mounting position or operating direction. As piston 50 moves, as is well known in hydraulic amplifiers, the pressure at port 90 of amplifier 48 will be substantially equal to the pressure at port 86 of pump 32 multiplied by the ratio of surface area of face 92 of piston 50 to the surface area of annular surface 94 of piston 50. This amplified pressure allows the extension of cylinder 24 even against full thrust delivered by a propulsion unit, over a limited range. When piston 50 reaches the predetermined end of its travel, valve 54 will open, allowing passage of fluid under unamplified pressure to port 90. From port 90, fluid flows through passage 96 in mounting provision 64, into annular groove 98, cross passage 100 and passage 102 in pivot means 62. From passage 102, fluid flows to passage 104 in base assembly 26, into valve chamber 106, and through central tube 108 of rod assembly 68. As will be apparent, this pressure acts on surface 110 or 110*a* of piston 70 or 70*a* or surface 112 or 112*a* of valve seat 76 or 76*a*, depending on whether or not valve seat 76 or 76*a* and piston 70 or 70*a* are in contact. In normal operation, valve seat 76 or 76*a* and piston 70 or 70*a* are in contact, fluid then flowing through tube 108 and aperture 78 or 78*a* to act between surface 112 or 112*a* of valve seat 76 or 76*a* and end surface 114 of bore 84, to cause the extension of cylinder assembly 24. Cylinder assembly 24, operatively coupled to a propulsion unit through pivot pin bore 116, causes the propulsion unit to be raised.

As cylinder 24 is extended, fluid displaced from chamber 118 defined by piston 70 or 70*a* in bore 84 flows through ports 120 in rod assembly 68 and into outer tube 122. Fluid from outer tube 122 flows through passage 124, cross passage 126, annular groove 128, and into passage 130 in mounting provision 64. From passage 130, fluid returns to port 132 of pump 32 through line 134, and pilot-operated check valve 40.

Should it be desired to contract cylinder assembly 24 to cause a propulsion unit to be lowered, motor 22 is energized to cause hydraulic fluid under pressure to appear at port 132. Pressure at port 132 opens pilot operated check valve 42, and also opens anti-supercharge valve 30 to connect port 86 of pump 32 to reservoir 38, to provide a path for excess fluid, caused by the fact that more fluid will returning from the chamber defined by surface 112 and 114 then will be supplied to chamber 118. Fluid under pressure flows from port 132 through check valve 40, line 134, passage 130, groove 128, cross passage 126, and passage 124, to outer tube 122 of rod assembly 68. From outer tube 122, fluid flows through ports 120 into chamber 118, forcing cylinder assembly 24 to contract. Valve seat 76 or 76*a*, being normally in sealing contact with piston 70 or 70*a*, will remain in contact with piston 70 or 70*a* as cylinder assembly 24 contracts. As cylinder assembly 24 contracts, fluid from the chamber defined by surfaces 112 and 114 will flow through aperture 78 or 78*a* in valve seat 76 or 76*a*, and into central tube 108 of rod assembly 68, through valve chamber 106, passage 104, passage 102, cross passage 100, groove 98, and into passage 96 in mounting provision 64.

From passage 96, fluid then flows into port 90 of pressure amplifier assembly 28, forcing differential piston 50 to the left, displacing fluid from the chamber defined by surfaces 58 and 92 into line 88. As piston 50 reaches the end of its stroke, plunger 56 of the switch means here shown as valve 54 will contact surface 58, or another stop means, opening valve 54 and allowing fluid flow from port 90 through passage 52 to line 88. Returning fluid in line 88 will flow through opened check valve 42, and to pump port 86, or to reservoir 38 through anti-supercharge valve 30, as required.

Should a propulsion unit operatively connected to the illustrated hydraulic system be suddenly forced to rise, due to impact within an obstacle, such as a floating log, a partially submerged rock, or the like, cylinder assembly 24 should be allowed to extend to dissipate the energy of the collision. It will be apparent that a second valve, similar to valve 82, or valve 60, could be emplaced in piston 70 to provide for this relative movement and dissipate the collision energy, but, in the illustrated embodiment, a pilot-operated check valve 60 is located in base assembly 26 for this propose. The use of a pilot-operated check valve provides better control over the opening pressure of a pressure relief valve, as well as providing more effective damping of the collision energy.

Collision with an obstacle causes fluid in chamber 118 to become pressurized. It should be noted that, at this time, check valves 40 and 42 are both closed, and pressure relief valves 44 and 46 are physically located too far away from cylinder assembly 24, and have insufficient flow capacity to be effective in relieving impulse pressure. Pressure appearing in chamber 118 will apear in outer tube 122, passage 124, and passage 136.

Figure 2:
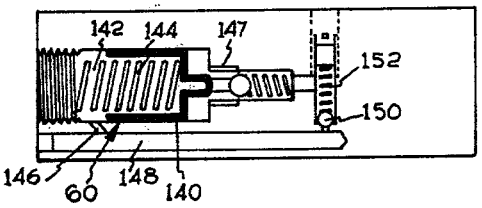
FIG. 2 is a partial sectional view of FIG. 1.

Referring to both FIGS. 1 and 2, pressure in passage 136 flows through a small bleed hole 138 in poppet 140, this pressure then appearing in chamber 142. At this point a spring 144 positioned in chamber 142, pushes poppet 140 against seat 146. Fluid under pressure in chamber 142 causes pressure in passage 146, and passage 148. Pressure in passage 148 opens valve 150 against the pressure of spring 152, allowing the pressure in passage 148 to be dissipated into passage 104. The sudden decrease in pressure of fluid in passage 148 is reflected into chamber 142 through passage 147. A pressure differential now existing between fluid in passage 136 and fluid in chamber 142, poppet 140 will be displaced from seat 147, allowing a high flow of fluid from passage 136 into valve chamber 106, through check valve 154, biased by a spring 156, and then into central tube 108 of rod assembly 68, then flowing around piston 70 or **70*a***.

As will be apparent, valve seat 76 or **76*a* being frictionally retained in bore 84, and central tube 108 supplying fluid to the area between valve seat 76 or 76*a* and surface 110 of piston 70 or 70*a*, piston 70 or 70*a* will be separated from valve seat 76 or 76*a*, valve seat 76 or 76*a*** maintaining its prior position.

After the energy of the collision has been dissipated through valve 60, or the like the force of gravity will cause a propulsion unit connected to cylinder assembly 24 at pivot pin bore 116, to fall, and will cause cylinder assembly 24 to contract, and cause piston 70 or **70*a* to move toward valve seat 76 or 76*a*. During this relative movement, fluid will be displaced from the area between piston 76 or 76*a* and surface 110 or 110*a* of piston 70 or 70*a*, flowing through aperture 74 or 74*a* and pressure relief valve 72 or 72*a*, into chamber 84, pressure relief valve 72 or 72*a* serving to cushion the return of a propulsion unit toward its original position. As will be apparent, when piston 70 or 70*a* and valve seat 76 or 76*a* come into contact, flow through aperture 74 or 74*a* will be prevented, thereby blocking the flow of fluid through piston 70 or 70*a* and preventing piston 70 or 70*a* from further motion. In this manner, a valve seat 76 or 76*a* serves as position memory element for the trim position of a propulsion unit for a watercraft, and also allows all hydraulic connections to be made at single end of a cylinder such as cylinder assembly 24**, for a compact and dependable arrangement, allowing the use of a pilot-operated check valve of higher flow capacity than of obtainable by a valve of equivalent function located in a piston.

Figure 3:
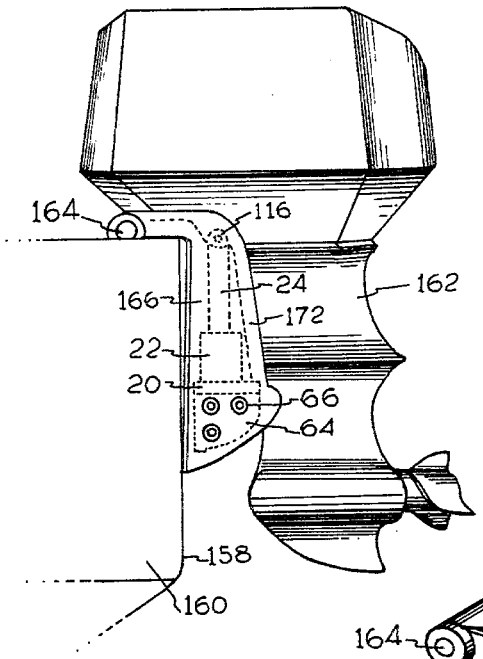
FIG. 3 is an illustration of the system of FIG. 1 as used with an outboard motor.
Figure 4:
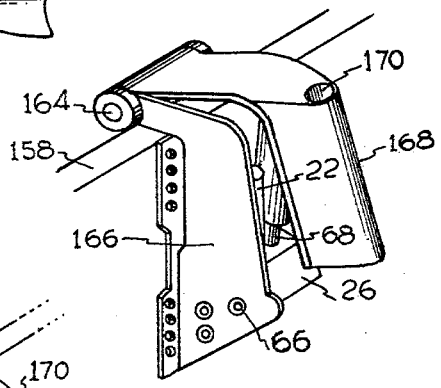
FIG. 4 is a partial detail view of FIG. 3.
Figure 5:
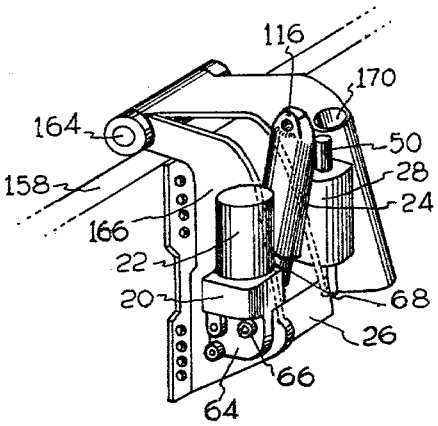
FIG. 5 is a phantom detail view of FIG. 4, showing a hydraulic system according to the invention.

FIGS. 3, 4 and 5 illustrate the hydraulic system schematically illustrated in FIGS. 1 and 2, as installed on a transom 158 of watercraft 160, to position an outboard motor 162 about a horizontal axis defined by pivot pin 164. As illustrated, a transom bracket 166 is mounted to transom 158, and carries pivot pin 164. Pivot pin 164 support a movable motor bracket 168 which has a pivot bore 170 for receiving a pivot pin 172 attached to outboard motor 162. Mechanically interposed between transom bracket 166 and motor bracket 168 is a unitary assembly embodying the hydraulic system shown in FIGS. 1 and 2, and marked with the same reference numbers as used in FIGS. 1 and 2.

Figure 6:
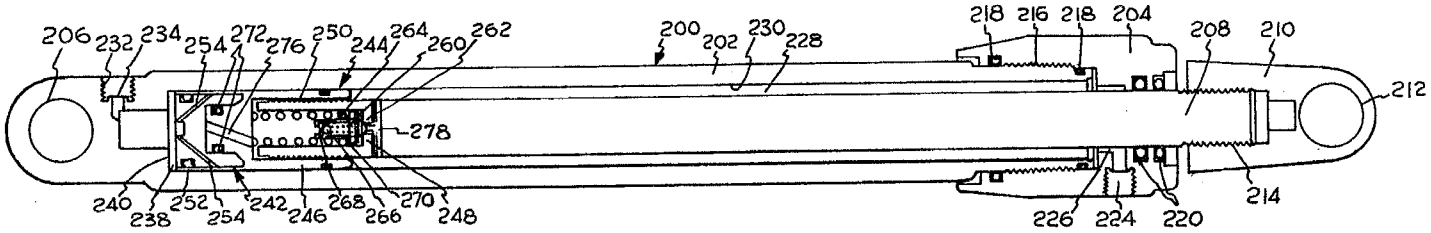
FIG. 6 is a sectional view of a hydraulic cylinder emboding the invention.

FIG. 6 illustrates a second embodiment of the invention, showing the use of a floating valve seat together with a concentric valve arrangement in a piston, suitable for uses including the trimming and tilting of inboard power units of watercraft. FIG. 6 illustrates a cylinder 200, having a cylinder body 202, and end cap 204, a means for mounting the stationary end of cylinder body 202, such as an aperture or eye 206, a piston rod 208, and means attaching the piston rod to surrounding structure, such as rod end 210 having mounting means such as aperture or eye 212, which is illustrated as being threadably attached to piston rod 208 at threaded portion 214. End cap 204 is illustrated as being attached to cylinder body 202 by means of threaded portions 216, and sealed to cylinder body 202 by seals 218. Seals, such as rod seals 220, allow rod 208 to movably extend through end cap 204 of cylinder 202, while preventing communication from the inside to the outside of cylinder 200 around rod 208.

End cap 204 is provided with a port 224, communicating with a passage 226, which in turn communicates with chamber 228, formed between rod 208 and bore 230 of cylinder body 202, hereinafter referred to as the rod-end chamber 238 for convenience in describing the operation of the invention. Cylinder body 202 is provided with a port 232 communicating with a passage 234, which communicates with an axial passage 236, connecting port 232 with a chamber 238, hereinafter referred to as a blind-end chamber 238. As illustrated in FIG. 6, chamber 238 is formed in bore 230 between end 240 and valve seat 242. As will become apparent, blind end chamber 238 may freely communicate with a third chamber, which may be formed between valve seat 242 and piston 244. As illustrated, piston 244 is comprised of an outer member 246, and an end 248 of rod 208 containing pressure-relief valves, which, as illustrated, is attached to outer member 246 by threaded portion 250.

Valve seat 242 is frictionally and slidably retained in bore 230, such as by friction means 252, and is provided with unrestricted passage 254 therethrough. Valve seat 242 is provided with a cup-shaped portion 256 for receiving an end 258 of piston 244.

Piston 244 contains two concentric pressure relief check valves, for allowing the movement of piston 244 in first and second directions. In the use shown in FIG. 9, a valve formed by valve member 260 and seat 262 may be called a jounce valve, to allow rod 208 to extend from cylinder 200. A spring 264 urges valve member 260 against seat 262. Valve member 266, urged against seat 268 by spring 270, forms a second valve, concentric with the first valve, which may be called a rebound valve, to allow rod 208 to retract into cylinder 202 under the influence of an external force. Portion 258 of piston 244 is fitted with seals 272, shown engaged with portion 256 of valve seat 242 in FIG. 6. Seals 274 form a seal between piston 244 and bore 230. Passages 276 form a path through piston 244 in which the above-mentioned jounce and rebound valves are interposed, to allow movement of piston 244 in first and second directions, under influence of an external force.

It should be noted that the above-described construction of piston 244 is also useable without a floating valve seat, to form a compact hydraulic cylinder for positioning a rod and absorbing shocks to the rod, without a position memory feature.

Figure 7:
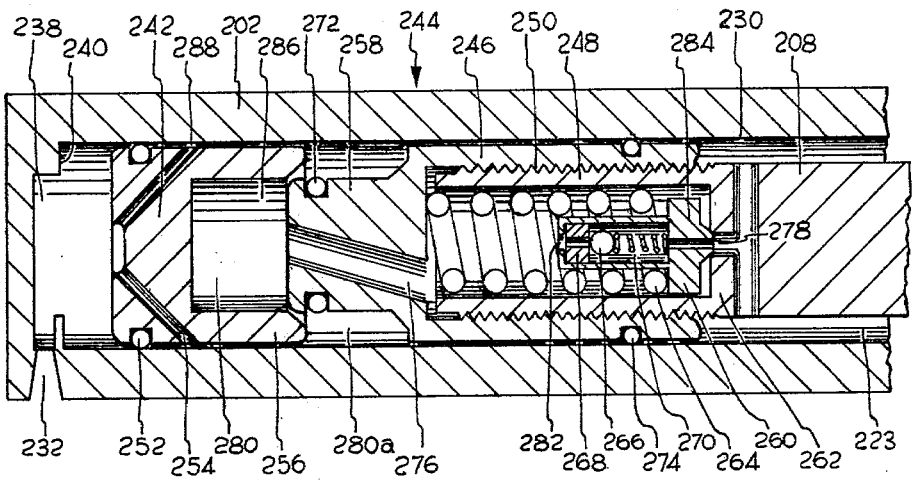
FIG. 7 is a detail view of the cylinder of FIG. 6, showing the piston and valve seat separated.
Figure 8:
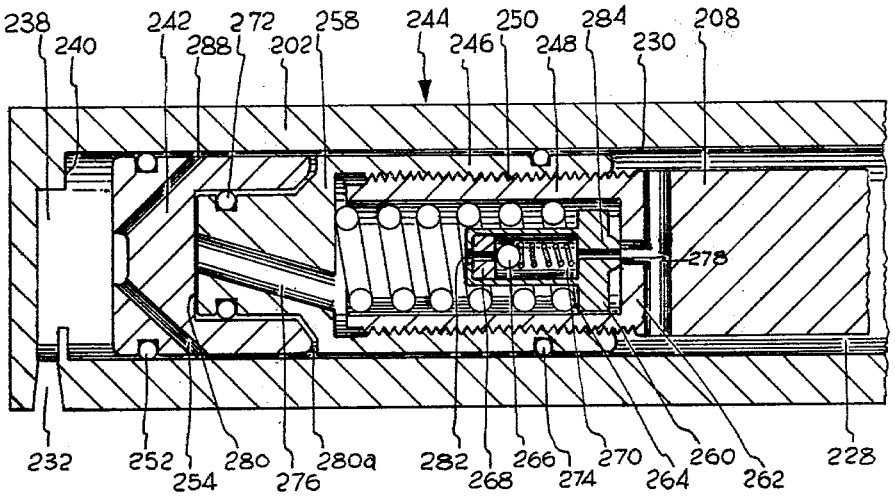
FIG. 8 is a detail view of the cylinder of FIG. 6, showing the piston and valve in contact with each other.

Turning now to FIGS. 7 and 8, the construction and operation of valve seat 242 and piston 244 are shown in somewhat schematic form, in greater detail. In FIG. 7, piston 244 and valve seat 242 are shown separated, as would be the case immediately following the collision of a propulsion unit of a watercraft with an obstacle, and before it had returned to its normal trim position. As illustrated, piston 244 would move to the right to allow a propulsion unit to deflect upon collision with an obstacle. It should be noted that directions of movement are used for explanation of operation only, and are not to be considered to be limitions on the scope of the invention, since the invention is insensitive to mounting position. As piston 244 moves to the right, fluid would flow from chamber 228, through T-shaped passage 278, pushing valve member 260 from seat 262, and flowing around the outer diameter of spring 264, between the coils of spring 264, and through passage 276 into a chamber 280, formed upon the separation of piston 244 and valve seat 242. It should be noted that, in the preferred embodiment, passage 276 is angled, since spring 264 may be compressed to its solid height, leaving no path between the coils of spring 264. Passage 276 is positioned to that fluid may enter either from the inner or outer diameter the coils of spring 264. Valve seat 242, being frictionally retained by friction means 254, remains in its original position.

Following the dissipation of the impact energy of a drive unit of a watercraft, piston 242 will move to the left, toward valve seat 242, with fluid flowing from chamber 280, through passage 276, through the inner diameter of spring 264, through passages 282 in seat 268, around valve member 266, through passage 284 in valve member 260, into passage 278, to chamber 228. As piston 244 nears its original position, seals 272 on piston end 258 will contact the interior surface 286 of cup-shape portion 256 of valve seat 242. Fluid will continue to be displaced from chamber 280 through passage 276 until piston 244 has returned to its original position. As will be apparent, when fluid is depleted from chamber 280, the flow of fluid through passage 276 is blocked so that piston 244 may no longer move toward valve seat 242. Fluid entrapped in chamber 280*a* after seals 272 have contacted surface 286 will pass to chamber 238 through space 288, between bore 230 and valve seat 242, and through passages 254. In this manner, valve seat 242 is responsive to hydraulic forces only when in contact with piston 244, and is insensitive to hydraulic forces when separated from piston 242, so that flexing of hydraulic lines, and the like, during displacement of a propulsion unit of watercraft will not cause change in trim position, and so that trim position can not be accidentally missadjusted during and immediately following a collision between a watercraft and a submerged object.

As will be apparent from FIG. 8, when piston 244 and valve seat 242 are in contact, there may be moved as a unit with hydraulic force. Assuming hydraulic pressure is applied to chamber 238 through port 232, the pressure in chamber 280*a* will be identical to the pressure in chamber 238, chamber 280*a* being connected through space 288, between the outer diameter of cup-shaped portion 256 and bore 230, and passage 276 to chamber 238, but there will be no tendency for seat 242 and valve 244 to separate, the pressure in chamber 280*a* acting on a lesser area than the pressure in chamber 238. The pressure in chamber 238 being lower than the pressure in chamber 238, the assembly of valve seat 242 and piston 244 would move to the right.

If hydraulic pressure were applied to chamber 228, the assembly of piston 244 and valve seat 242 would move to the left, and remain joined, there being no path for fluid through passage 278 to chamber 280, valve member 260 being urged against valve seat 262 by spring 264 with a force sufficient to withstand normal operating hydraulic pressures. In the embodiment illustrated, as well as in the embodiment illustrated in FIGS. 1 through 5, the valve which allows the piston and valve seat to separate under shock load on a propulsion unit is set to operate at approximately 10,000 PSI, well above the normal operating pressure range, and the valve which allows the piston to return to its original position is set to operate at approximately 30 PSI.

Figure 9:
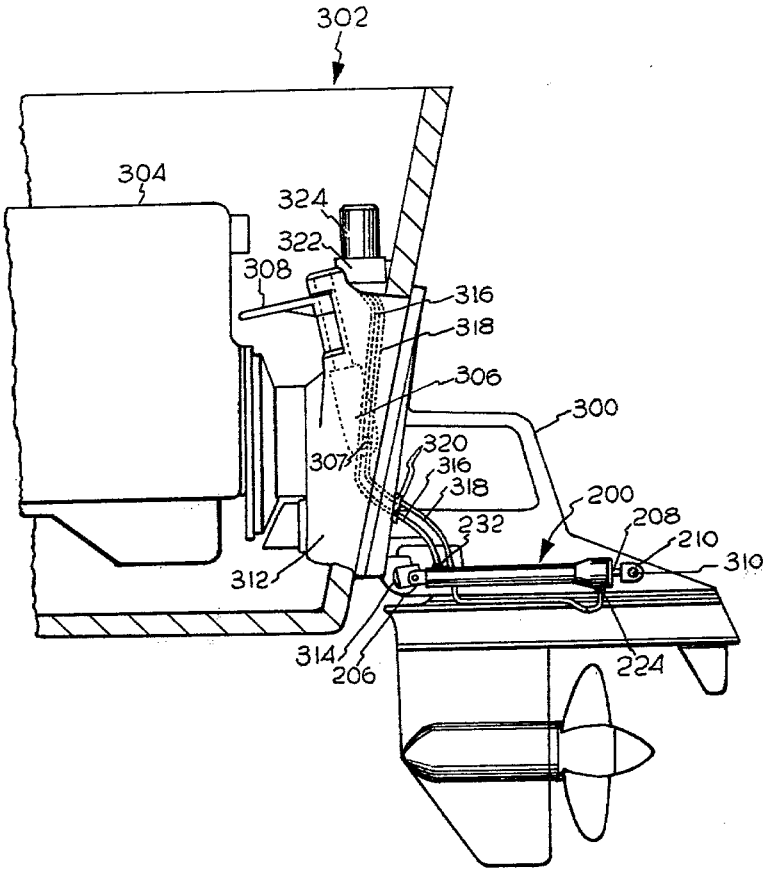
FIG. 9 shows the installation of the cylinder shown in FIG. 6 as used on an inboard drive for a watercraft.

FIG. 9 shows a cylinder 200 as used with a propulsion unit 300 for a watercraft 302 having an engine 304. As shown, propulsion unit 300 is mounted on yoke 306, and pivots vertically around pin 307, and is steerable by means of steering arm 308 on yoke 306. Cylinder 200 is attached to drive unit 300 at pin 310, and to transom bracket 312 by support 314, pivotally mounted to transom bracket 312, for pivoting about the same axes as yoke 306. Further details of propulsion unit 300 and its mounting may be found in U.S. Pat. No. 3,893,407, issued to John W. Hurst on July 8, 1975. As illustrated, hydraulic lines 316 and 318 are connected to ports 232 and 224, respectively, and pass through bracket 312 at fitting 320, and are connected to a pump and valve body 322, containing a valve arrangement similar to that shown in FIG. 1, having a pump driven by a motor 324.

As will be apparent to one skilled in the art, numerous changes and modifications may be made to the discribed embodiment of the invention, such as by the use of various types of valves in various locations, and various configurations for pistons and position-retentive valves seats, without departing from the spirit and scope of the invention.

We claim:

1. A hydraulic cylinder, wherein:

said cylinder is provided with a bore therein;

a piston is slidably disposed inside said bore and separates said bore into a first chamber and a second chamber;

said piston being attached to a rod;

said rod protruding through said second chamber and outside said cylinder;

a valve seat means is disposed in said first chamber and frictionally retained therein;

said valve seat means having a first surface and a second surface and a first passage therethrough interconnecting said first surface and said second surface for allowing a fluid to flow substantially unrestricted therethrough;

said piston having a second passage therethrough, said second passage being provided with first valve means therein for allowing a flow of fluid in a first direction therethrough and preventing a flow of fluid in a second direction therethrough;

said valve seat means is adapted to occlude said second passage and prevent a flow of fluid therethrough when said valve seat means is adjacent said piston;

said cylinder including means for allowing a flow of fluid past said piston in said second direction;

whereby said piston may be moved away from said valve seat means, said valve seat means remaining in a predetermined position, and said valve seat means occluding said second passage and stopping a flow of fluid through said second passage and stopping said piston in a predetermined position thereby when said piston is moved towards said valve seat means.

2. A hydraulic cylinder according to claim 1, wherein:

said valve seat means is a disk-shaped member having said first passage therethrough formed in said disk-shaped member;

3. A hydraulic cylinder according to claim 2, wherein:

said piston is provided with sealing means adapted to cooperate with said valve seat means to occlude said second passage.

4. A hydraulic cylinder according to claim 3, wherein:

said sealing means is provided on a surface of said piston;

said piston having a surface facing said valve seat means;

said surface being provided with a plurality of concentric projections thereon, said second passage having an entrance formed in said surface between two said concentric projections.

5. A hydraulic cylinder according to claim 4, wherein:

said first valve means is a pressure relief valve operative at a first predetermined pressure.

6. A hydraulic cylinder according to claim 5, wherein:

said means for allowing a flow of fluid through said piston in said second direction is a third passage formed through said piston, said third passage being provided with second valve means therein for allowing a flow of fluid in said second direction therethrough and preventing a flow of fluid in said first direction therethrough;

said second valve means being pressure relief valve operative at a second predetermined pressure, said second predetermined pressure being higher than said first predetermined pressure.

7. A hydraulic cylinder according to claim 2, wherein said valve seat is provided with sealing means adapted to cooperate with said piston means to occlude said second passage.

8. A hydraulic cylinder according to claim 7, wherein:

said sealing means is provided on a surface of said valve seat means;

said valve seat means having a surface facing said piston means;

said surface being provided with a plurality of concentric projections thereon adapted to sealingly occlude said second passage in said piston.

9. A hydraulic cylinder according to claim 8, wherein;

said first valve means is pressure relief valve operative at a first predetermined pressure.

10. A hydraulic cylinder according to claim 1, wherein:

said valve seat means is a cup shaped member having a concave surface facing said piston, said piston having a projection therefrom adapted to cooperate with said concave surface to occlude said second passage and prevent a flow of fluid through said first valve means.

11. A hydraulic cylinder according to claim 1 or 10, wherein:

said means for allowing a flow of fluid past said piston in said second direction is a third passage in said piston, said third passage being provided with a second valve means; and said first valve means and said second valve means are concentric valves, said first valve means being operable at a substantially different pressure than said second valve means.

12. A hydraulic cylinder, wherein:

said cylinder is provided with a bore therein;

a piston is slidably disposed inside said bore and separates said bore into a first chamber and a second chamber;

said piston being attached to a rod;

said rod protruding through said second chamber and outside said cylinder;

first and second valve means in said piston interconnecting said first and second chambers;

said first valve means preventing a flow of fluid in a first direction and allowing a flow of said fluid in second direction therethrough;

said second valve means preventing a flow of said fluid in a second direction and allowing a flow of said fluid in a first direction therethrough;

said first valve means and said second valve means being concentrically disposed in said piston.

13. A hydraulic cylinder according to claim 12, wherein:

said first and second valve means are concentric with said piston and said rod.

14. A hydraulic cylinder according to claim 12 or 13 wherein said first valve means is operative at a first predetermined pressure, and said second valve means is operative at a second predetermined pressure.

15. A vertical positioning apparatus for an outboard propulsion unit for watercraft having a horizontal axis for vertical rotation of said propulsion unit about said horizontal axis and hydraulic means for rotating said propulsion unit about said horizontal axis, said hydraulic means comprising:

cylinder means operably connected between said watercraft and said outboard propulsion unit;

a source of pressurized fluid for causing said cylinder means to extend and retract;

said cylinder means having a bore therein;

a piston being slidably disposed in said bore and separating said bore into a first chamber and a second chamber;

said source of pressurized fluid including means for precluding the flow of fluid between said first and second chambers;

a rod attached to said piston and extending through said first chamber;

first valve means in said piston for allowing said piston to move in a first direction;

second valve means in said hydraulic means for allowing said piston to move in a second direction;

valve seat means slidably disposed in said second chamber, said valve seat having a substantially unrestricted fluid passage therethrough;

said valve seat being adapted to occlude said first valve means to prevent said piston from moving in said first direction;

said valve seat being normally engaged with said piston for positioning said propulsion unit in an operating trim position;

said second valve means being adapted to prevent the flow of fluid therethrough in response to reverse thrust of said propulsion unit and to allow the flow of fluid therethrough in response to said propulsion unit colliding with an obstacle to allow said piston to move in said second direction away from said valve seat, said valve seat remaining motionless, and to damp the movement of said piston;

said first valve means allowing said piston to return is said first direction subsequent to said collision, said valve seat means occluding said first valve means to stop said piston upon reengagement of said piston and said valve seat to reestabish said operating trim position.

16. A positioning apparatus according to claim 15, wherein:

said second valve means is disposed in said piston.

17. A positioning apparatus according to claim 16, wherein:

said first valve means and said second valve means are concentrically mounted in said piston and concentric with said piston.

18. A positioning apparatus according to claim 15, wherein:

said source of pressurized fluid is a reversible pump operably connected to first and second pilot-operated check valves, said first and second check valves being operably connected to said first and second chambers.

19. A positioning apparatus according to claim 15 or 18, wherein:

said source of pressurized fluid is operably connected to said first and second chambers through passages in said rod.

20. A positioning apparatus according to claim 19, wherein:

said rod includes a first tube and a second tube, said first and second tubes being concentric, said first tube having an opening therein connecting the interior of said first tube and said first chamber, said second tube passing through said piston, and into said second chamber.

21. A positioning apparatus according to claim 15, wherein:

said source of pressurized fluid is a reversible pump operably connected to first and second pilot-operated check valves, said first and second check valves being operably connected to said first and second chambers;

a pressure amplifier being interposed between said source of pressurized fluid and said second chamber for supplying an amplified force to said piston for positioning said piston in opposition to thrust force of said propulsion unit;

said pressure amplifier being provided with switch means for bypassing said pressure amplifier in response to said propulsion unit being in a predetermined position.

22. A hydraulic cylinder, wherein:

said cylinder is provided with a bore therein;

a piston is slidably disposed inside said bore and separates said bore into a first chamber and a second chamber;

said piston being attached to a rod;

said rod protruding through said second chamber and outside said cylinder;

a valve seat means is disposed in said first chamber and frictionally retained therein;

said valve seat means having a first passage therethrough for allowing a fluid to flow therethrough;

said piston having a second passage therethrough, said second passage being provided with first valve means therein for allowing a flow of fluid in a first direction therethrough and preventing a flow of fluid in a second direction therethrough;

said valve seat means is adapted to occlude said second passage and prevent a flow of fluid therethrough when said valve seat means is adjacent said piston;

said cylinder including means for allowing a flow of fluid past said piston in said second direction;

whereby said piston may be moved away from said valve seat means, said valve seat means remaining in a predetermined position, and said valve seat means stopping a flow of fluid through said second passage and stopping said piston in a predetermined position thereby when said piston is moved towards said valve seat means;

said valve seat means being a disk-shaped member having a first passage therethrough formed in said disk-shaped member;

said valve seat means being provided with sealing means adapted to cooperate with said second means to occlude said second passage;

said sealing means being provided on a surface of said valve seat means;

said valve seat means having a surface facing said piston means;

said surface being provided with a plurality of concentric projections therein adapted to sealingly occlude said second passage in said piston.

23. A hydraulic cylinder according to claim 22, wherein:

said first valve means is a pressure relief valve operative at a first predetermined pressure.

24. A vertical positioning apparatus for an outboard propulsion unit for watercraft having a horizontal axis for vertical rotation of said propulsion unit about said horizontal axis and hydraulic means for rotating said propulsion unit about said horizontal axis, said hydraulic means comprising:

cylinder means operably connected between said watercraft and said outboard propulsion units;

a source of pressurized fluid for causing said cylinder means to extend and retract;

a cylinder means having a bore therein;

a piston being slidably disposed in said bore and separating said bore into a first chamber and a second chamber;

a source of pressurized fluid including means for precluding the flow of fluid between said first and second chambers through said source of pressurized fluid;

first valve means in said piston for allowing said piston to move in a first direction;

second valve means in said hydraulic means for allowing said piston to move in a second direction;

valve seat means slidably disposed in said second chamber, said valve seat having a substantially unrestricted fluid passage therethrough;

said valve seat being adapted to occlude said first valve means to prevent said piston from moving in said first direction;

said valve seat being normally engaged with said piston for positioning said propulsion unit in an operating trim position;

said second valve means being adapted to prevent the flow of fluid therethrough in response to reverse thrust of said propulsion unit and to allow the flow of fluid therethrough in response to said propulsion unit colliding with an obstacle to allow said piston to move in said second direction away from said valve seat, said valve seat remaining motionless, and to damp the movement of said piston;

said first valve means allowing said piston to return in said first direction subsequent to said collision, said valve seat means occluding said first valve means to stop the flow of a fluid therethrough to stop said piston upon reengagement of said piston and said valve seat, to reestablish said operating trim position, said source of pressurized fluid being a reversible pump connected to first and second pilot-operated check valves, said first and second check valves being operably connected to said first and second chambers;

a pressure amplifier being interposed between said source of pressurized fluid and said second chamber for supplying an amplified force to said piston for positioning said position operation in opposition to thrust force of said propulsion unit;

said pressure amplifier being provided with switch means for bypassing said pressure amplifier in response to said propulsion unit being in a predetermined position.

* * * * *

UNITED STATES PATENT AND TRADEMARK OFFICE

CERTIFICATE OF CORRECTION

PATENT NO. : 4,325,700

DATED : April 20, 1982

INVENTOR(S) : Calvin V. Kern, Lawrence P. Zepp

It is certified that error appears in the above-identified patent and that said Letters Patent are hereby corrected as shown below:

Column 1, line 7, change "Particular" to --particular--;
line 55, change "unyeildingly" to --unyieldingly--.
Column 2, line 56, change "emboding" to --embodying--;
line 66, change "emboding" to --embodying--;
Column 3, line 9, change "emboding" to --embodying--;
line 64, before "76" delete "or".
Column 4, line 52, change "returning" to --return--;
line 53, change "then" to --than--.
Column 5, line 60, after "like" put a comma.
Column 7, line 49, change "to" to --so--;
line 50, after "diameter" put --of--.
Column 8, line 10, change "missadjusted" to --misadjusted--;
line 20, change "276" to --254--;
line 24, change "238" to --228--;
line 58, change "discribed" to --described--;
line 63, after "position-retentive" change "valves" to --valve--.
Column 11, line 41, after "return" change "is" to --in--;
Column 11, line 45, change "reestabish" to --reestablish--.

Signed and Sealed this

*Twenty-first* Day of *December 1982*

[SEAL]

*Attest:*

GERALD J. MOSSINGHOFF

*Attesting Officer*

*Commissioner of Patents and Trademarks*